United States Patent [19]

Cremonese

[11] Patent Number: 4,459,131

[45] Date of Patent: Jul. 10, 1984

[54] MATCH

[76] Inventor: Henry V. Cremonese, 125 Christopher St., No. 24, New York, N.Y. 10014

[21] Appl. No.: 422,168

[22] Filed: Sep. 23, 1982

[51] Int. Cl.[3] ..... C06F 3/00; C06F 3/02

[52] U.S. Cl. ..... 44/42; 44/46; 206/96

[58] Field of Search ..... 44/42, 46, 43, 44, 47; 206/96, 106

[56] References Cited

U.S. PATENT DOCUMENTS 1,056,177 3/1913 Humphrey ..... 44/46

1,865,716 7/1932 Waldinger ..... 44/44

FOREIGN PATENT DOCUMENTS 11212 of 1901 United Kingdom ..... 44/42

862932 3/1961 United Kingdom ..... 44/46

*Primary Examiner*—Carl F. Dees

*Attorney, Agent, or Firm*—Costas, Montgomery & Dorman

[57] ABSTRACT

A match will sustain burning for a limited period of time comprising a splint having a combustible head and a cut-out extending defining spaced apart arms extending from adjacent the head to below any burn sustaining coating on the match.

10 Claims, 9 Drawing Figures

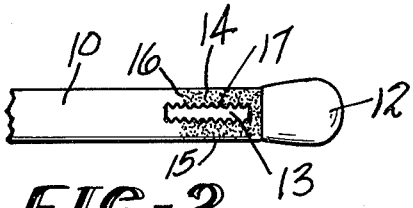
FIG-2
FIG-1
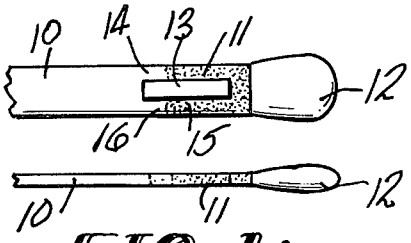
FIG-1A
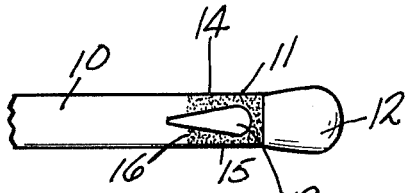
FIG-4
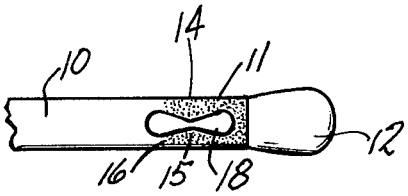
FIG-3
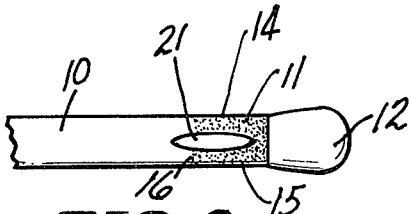
FIG 6
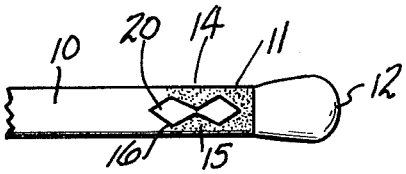
FIG-5
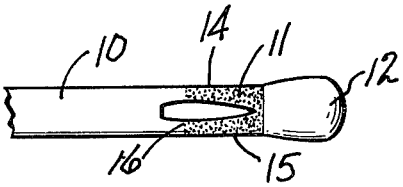
FIG-8
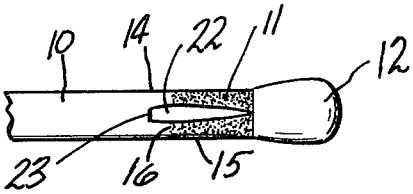
FIG-7

MATCH

FIELD OF THE INVENTION

This invention relates to matches and more particularly, relates to matches which are substantially self-extinguishing.

BACKGROUND OF THE INVENTION

The common book match comprises a stem of cellulosic material having a combustible head portion. In many cases, the matches will be coated a quarter of an inch to three-eighths of an inch downwardly from the head with a material designed to sustain burning of the match after the head has been consumed. In the progress of burning a match, there is not direct oxidation of solid material, but the burn progresses through the procedure of gas generation and burning of the gas. If the gas generation is inhibited by deterring the transfer of heat, most substances will cease to burn. The structure of a flame in general involves interiorly non-burning gases which ignite only at the exterior portions of the flame, where a mixture with air produces a flammable gas mixture. If one should strike a book match and hold it upright in the absence of air movement, the match will essentially self-extinguish after it has burned down to the aforementioned coating.

Careless use of matches and also use of matches by children are responsible for many fires. In many cases, a match may be discarded while still burning and may land on an object which it will ignite. Additionally, it has been known that small children will burn matches to determine how long they can be held, and then they suddenly drop the match while it is burning to avoid burning fingers.

Proposals have been made to coat matches at least partially with a fire retarding material along the stem so that only part of the match surface will sustain a flame, and then only when the flammable head of the match is held downwardly, with respect to the main portion of the match stem. Such a concept is disclosed in U.S. Pat. No. 3,838,989. In the manufacture of matches, a wide strip of cellulosic material is coated with the sustaining composition a small distance from the head end. The strip is then dried and slit into the individual match stems which are then dipped into a composition which may consist of a mixture of glue, potassium chlorate, sulphur, an abrasive filler, and perhaps a dye, and permitted to dry. The assemblies may then be separated by transverse cuts and conventionally assembled and stapled to the match book cover carrying a dried strip of striking material such as a misture of red phosphorous, abrasive and glue.

The present invention may be embodied in the conventional method of manufacture of book matches as described above.

SUMMARY OF THE INVENTION

The invention comprises the provision of a cut-out or slot in the stem of a match just below the head. The cut-out decreases the width of the burning material below the head and further extends below the presoaked coating on the match if the match has been presoaked. When struck, the head will combust and then the presoaked area will sustain burning of the match even if held in a vertical position. The flame passes down the parallel arms defined by the slot, consuming the match, but when it reaches the bottom of the cut-out, it will die out.

It is believed that this is due to a decrease in the transfer of heat along the match stem where the area decreases, resulting in less gas generation for burning. This will occur also if the match is held in a horizontal position. However, the flame will continue if the match is held with its head down. It has further been noted that the notch will extinguish upon impact if dropped, if not before, due to the fluttering motion from the hand to the ground.

Preferably, in defining the slot, it is made about one-third of the width of the match stem and approximately three-eighths of an inch long extending from a point at or very closely adjacent the combustible head of the match. The slot will always extend beyond the area that is presoaked to sustain burn.

An object of this invention is to provide a new and improved match which will sustain burning for only a limited time.

The features of the invention which are believed to be novel are particularly pointed out and distinctly claimed in the concluding portion of the Specification. The invention, however, together with further objects and advantages thereof, may best be appreciated by reference to the following detailed description taken in conjunction with the drawings.

BRIEF DESCRIPTION OF THE DRAWINGS

FIG. 1*a* is a view of a match embodying the invention;

FIG. 1*b* is a side view of the match of FIG. 1; and

FIGS. 2–8 are views of other embodiments of the invention.

DETAILED DESCRIPTION OF THE ILLUSTRATED EMBODIMENT

In a typical book of paper matches, a plurality of match splints made of cardboard or hard paper, are usually arranged in two parallel rows projecting from a narrow marginal strip to which is stapled a foldable flexible paper safety cover flap with a striking surface attached thereto. In the manufacture of the matches, the raw stock is subjected to a diecutting operation to produce what is known as combs. These are a plurality of unfinished splints extending from a lower marginal portion. The outer free ends of the splints are then impregnated during a presoak process with a material such as hot paraffin wax. The purpose of the paraffin is to transmit the flame from an ignited pyrotechnic mixture forming the match head to the body portion of the match splint. The paraffin is applied most commonly by immersing the splints into an open pan containing hot paraffin. Then the head ends are dipped into a flammable composition which may be a conventional composition consisting, for example, of a mixture of glue, potassium chlorate, sulphur, a filler which may be in the form of an abrasive nature, and a dye, all in the form of an aqueous paste. The pyrotechnic head material is then permitted to dry; the combs are cut to length, assembled and stapled to the match-book cover, which carries a dried strip of striking material which may be a mixture of red phosphorous, abrasive and glue.

In accordance with the invention, when the initial stock is cut into combs, a cut-out is defined in a splint just below the head of the match and extending below the presoaked portion. As shown in FIG. 1, a match comprises a splint 10 having an area of presoak 11 extending from pyrotechnic head 12. Just below head 12, a slot 13 is defined in the splint 10 intermediate the edges thereof and defining arms 14 and 15 on the splint.

As shown in FIGS. 1*a* and 1*b*, the slot extends from a point adjacent the head 12 longitudinally of the splint 10 and beyond the presoak area 11. It is preferred that the widest portion of the slot be no more than about one-third of the width of the match splint. The length of slot 13 will depend upon the length of the presoak 11 and preferably should extend one-quarter to three-eighths of an inch beyond the end 16 of the presoak. The slot may be made in many configurations. As exemplified in FIG. 2, the edges of slot 13 are defined by a series of arcs 17.

As shown in FIG. 3, a slot 18 may be in the form of an elongated outline of a figure eight or a teardrop shape 19, as shown in FIG. 4. The slot may be in the form of a double diamond 20, as shown in FIG. 5, or generally oval, bi-convex ellipsoid 21 as shown in FIG. 6. A further preferred form is shown in FIGS. 7 and 8, where slot 22 is generally ellipsoid from the head as it extends along the length of the splint as it terminates in a flat or straight-edge 23 at the bight between the arms 14 and 15. In one form of this embodiment (FIG. 7), the slot extends to the head of the match.

Regardless of the shape of the cut-out, the major dimension across the width thereof is approximately one-third of the width of the match splint. When a match embodying the invention is struck and ignited and held in a vertical position, that is, with the head up, the flame will propogate through the combustible material 11 until it reaches the bight at the bottom of arms 14 and 15. At this point, the match will extinguish. If the match is thrown or dropped after striking, it will usually go out as it falls through the air, but if not, upon impact, it will extinguish.

It may thus be seen that the objects of the invention are efficiently attained. While preferred embodiments of the invention have been set forth for purposes of disclosure, other embodiments of the invention, as well as modifications to the disclosed embodiments, may occur to those skilled in the art. Accordingly, the appended claims are intended to cover all embodiments of the invention which do not depart from the spirit and scope thereof.

Having thus described the invention, what is claimed is:

1. A match comprising a fibrous splint of carboard or hard paper, a pyrotechnic head on one end of said splint, a combustible material on said splint extending along a portion of the length of said splint from said head, said splint having essentially parallel side edges from the head to the end and being of substantially rectangular cross section, said splint having spaced apart arms defining a through slot extending longitudinally of said splint from adjacent said head to beyond said combustible material.

2. The match of claim 1, wherein said slot extends about one-quarter inch beyond said combustible material.

3. The match of claim 1, wherein said slot extends at least one-quarter inch beyond said combustible material.

4. The match of claim 1, wherein said slot is rectangular in outline.

5. The match of claim 1, wherein said slot is about one-third the width of said splint at its widest point.

6. The match of claim 1, wherein said slot extends to said head.

7. The match of claim 1, wherein the end of said slot adjacent said head is spaced from said head.

8. The match of claim 1, wherein said slot is generally ellipsoid in shape, extending from a point adjacent said head and defining spaced apart arms on said splint, the bight of said arms being substantially perpendicular to said arms.

9. The match of claim 8 where said slot extends to said head.

10. The match of claim 1 where said slot is bi-convex in shape.

* * * * *

UNITED STATES PATENT AND TRADEMARK OFFICE

CERTIFICATE OF CORRECTION

PATENT NO. : 4,459,131

DATED : July 10, 1984

INVENTOR(S) : HENRY V. CREMONESE

It is certified that error appears in the above-identified patent and that said Letters Patent are hereby corrected as shown below:

Claim 1, Column 4, Line 7, change "carboard" to

-- cardboard --.

Signed and Sealed this

*Eleventh* Day of *December 1984*

[SEAL]

*Attest:*

GERALD J. MOSSINGHOFF

*Attesting Officer* *Commissioner of Patents and Trademarks*